US005644817A

United States Patent [19]

Bender et al.

[11] Patent Number: 5,644,817

[45] Date of Patent: Jul. 8, 1997

[54] LOCATOR PIN ASSEMBLY FOR A VEHICLE DOOR

[75] Inventors: Frederick F. Bender, South Lyon; Robert F. Giorio, Livonia, both of Mich.

[73] Assignee: Chrysler Corporation, Auburn Hills, Mich.

[21] Appl. No.: 731,548

[22] Filed: Oct. 17, 1996

[51] Int. Cl.[6] ..... E05D 5/00

[52] U.S. Cl. ..... 16/382; 16/270

[58] Field of Search ..... 16/382, 384, 262, 16/261, 254, 265, 268, 270, 271, 272, 257, DIG. 40, DIG. 43

[56] References Cited

U.S. PATENT DOCUMENTS

| | | | |
|---|---|---|---|
| 3,542,138 | 11/1970 | Fackler | 16/262 |
| 4,720,895 | 1/1988 | Peebles | 16/382 |
| 5,029,364 | 7/1991 | Salazar | 16/382 |
| 5,297,314 | 3/1994 | Bender et al. | 16/270 |
| 5,444,894 | 8/1995 | Heiler | 16/262 |
| 5,570,498 | 11/1996 | Hipkiss et al. | 16/261 |

*Primary Examiner*—Chuck Y. Mah
*Attorney, Agent, or Firm*—Edward A. Craig

[57] ABSTRACT

Hinge apparatus for a door of a motor vehicle providing precise door-on-door-off capability enabling the door to be hinged to a vehicle body post in adjusted position, unhinged, and then re-hinged in the same adjusted position. A pair of hinges connect a door panel to a body post panel. Each hinge comprises a first hinge plate connected to the body post panel and a second hinge plate connected to the door panel. A tapping plate is secured to the door panel and has a pair of spaced threaded holes therein. Clearance openings are provided in the second hinge plate and in the door panel in alignment with the threaded holes in the tapping plate to clear mounting screws which are threaded into the tapping plate. The clearance holes are large enough to allow adjustment of the door. A locator comprises a tab secured to the second hinge plate, provided with a locator pin adapted to extend into a locator hole in the tapping plate. The tab is secured in position on the second hinge plate by a thermosetting adhesive which is activated after the screws have clamped the door to the hinge plate. Thereafter, the door may be unhinged, and later re-hinged in the exact same position because of the presence of the tab and the engagement of the tab locator pin in the locator hole in the tapping plate.

12 Claims, 3 Drawing Sheets

LOCATOR PIN ASSEMBLY FOR A VEHICLE DOOR

FIELD OF THE INVENTION

This invention relates generally to hinge apparatus for a door of a motor vehicle and more particularly to such an apparatus having a locator pin assembly providing precise door-on-door-off capability.

BACKGROUND OF THE INVENTION

In hinges for automotive doors having door-on-door-off capability, the door is fully installed on the vehicle body at one stage of an assembly line and, during such installation, the door and body hinges are adjusted as necessary to achieve a proper fit between the door and the body. Thereafter, the door may be removed from the body to allow for easier installation of body components (i.e., seats, instrument panel, etc.). The door may be trimmed on its own line. The hinges are designed to enable the door to be quickly and easily re-installed in exactly the same position without the need for further adjustment of the door relative to the body.

One known system involves installing a fixed anchor plate on a door flange for a door hinge wherein a pair of oversize bolt holes are drilled in the door hinge web. The hinge is loosely mounted by a pair of shoulder bolts extending through the oversize holes for engagement in an aligned anchor plate and door flange threaded bores. The outboard shoulder bolt includes a net washer assembly having a washer hole sized to provide a close tolerance fit with its bolt shoulder together with a thermosetting adhesive film pre-applied to the mating side of the net washer. Upon the door and the body exterior surfaces being adjustably aligned, the hinge assembly bolts are tightened. Thereafter, the vehicle body is moved through a painting stage wherein the adhesive film is heated to its curing temperature thereby bonding the net washer to the hinge web. The door can then be removed to facilitate a trim operation while the bonded net washer maintains the positional relationship between the door hinge and vehicle door that was established earlier during the door fitting stage.

SUMMARY OF THE INVENTION

In the specific embodiment of the invention to be described, the hinge apparatus for a vehicle door enables the door to be hinged to a vehicle body post in adjusted position, unhinged, and then re-hinged in the same adjusted position. A pair of hinges are provided each having pivoted hinge plates connected respectively to a door panel and to a body post panel. A tapping plate having a threaded hole or holes therein is secured to one of the panels, preferably the door panel. The hinge plate for the door panel has a locator secured to it, comprising a tab provided with a clearance hole aligned with one of the threaded holes in the tapping plate. A mounting screw extends through the clearance hole in the tab and through clearance openings in the hinge plate and the door panel and threads into one of the threaded holes in the tapping plate. The tab also has a locator pin which is closely received in a locator hole in the door panel. A film of epoxy or other adhesive material bonds the tab to the hinge plate.

One object of the invention is to provide a hinge arrangement with door-on-door-off capability having the foregoing features and advantages.

Another object is to provide a hinge arrangement which is composed of a relatively few simple parts, is ragged and durable in use, permits the door to be unhinged and re-hinged in exactly the same location quickly and easily, and is capable of being inexpensively manufactured and readily assembled.

These and other objects, features and advantages of the invention will become more apparent as the following description proceeds, especially when considered with the accompanying drawings.

DETAILED DESCRIPTION OF THE PREFERRED EMBODIMENT

Figure 1:
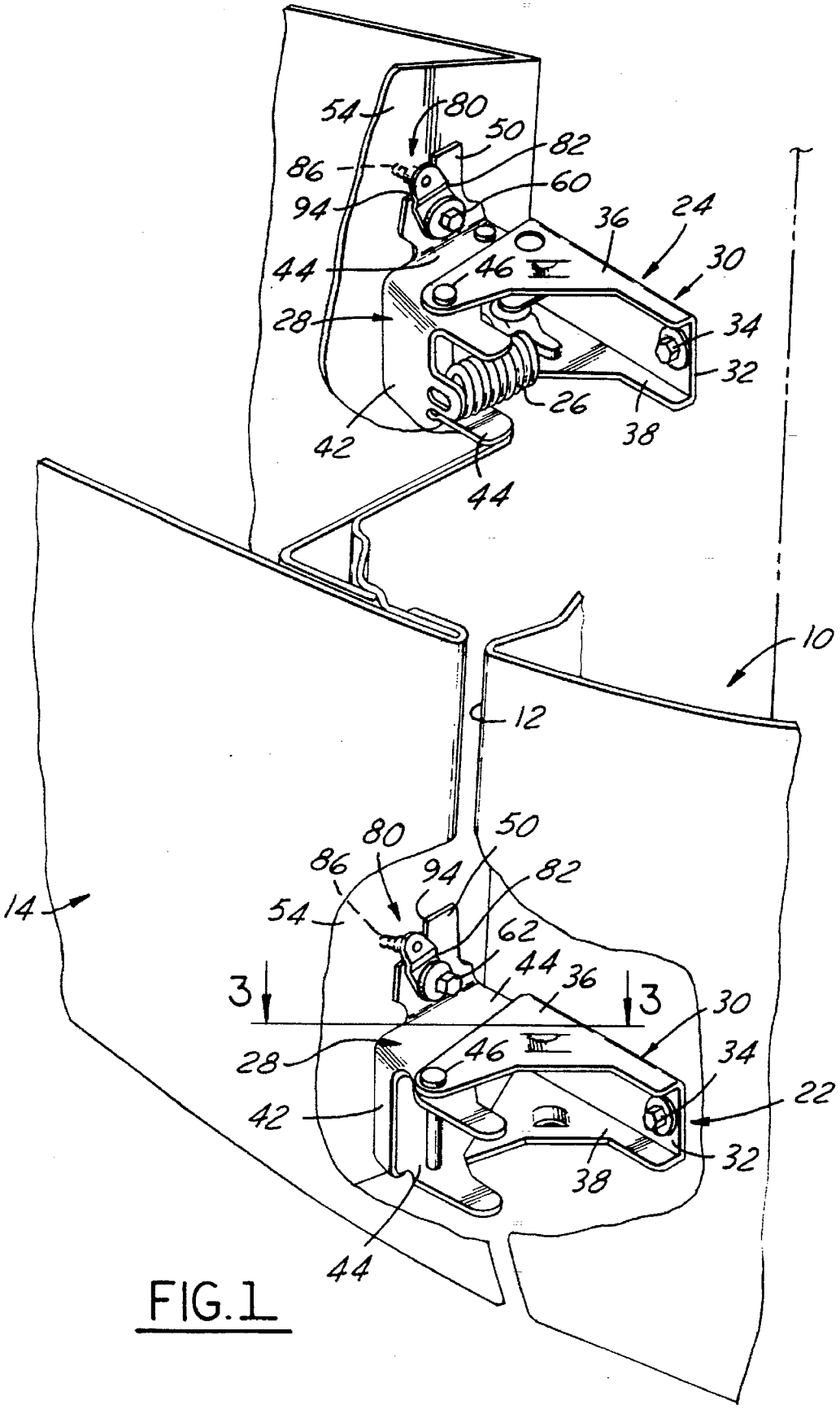
FIG. 1 is a fragmentary perspective view of a door mounted on a vehicle body by upper and lower hinge assemblies in accordance with the present invention.

Referring now more particularly to the drawings, a vehicle body 10 is shown having a door opening 12 for a vehicle door 14. The vehicle body has a box-shaped hinge pillar 16 partially defined by an outer body section 18 formed with a hinge mounting panel 20. The panel 20 supports a lower hinge 22 and an upper hinge 24. The hinges 22 and 24 are substantially identical except that the upper hinge has a hold-open cam spring device 26, and are mounted in the same manner. Hence, only the lower hinge 22 will be shown and described in detail, with the same reference characters describing the parts of both hinges.

Figure 3:
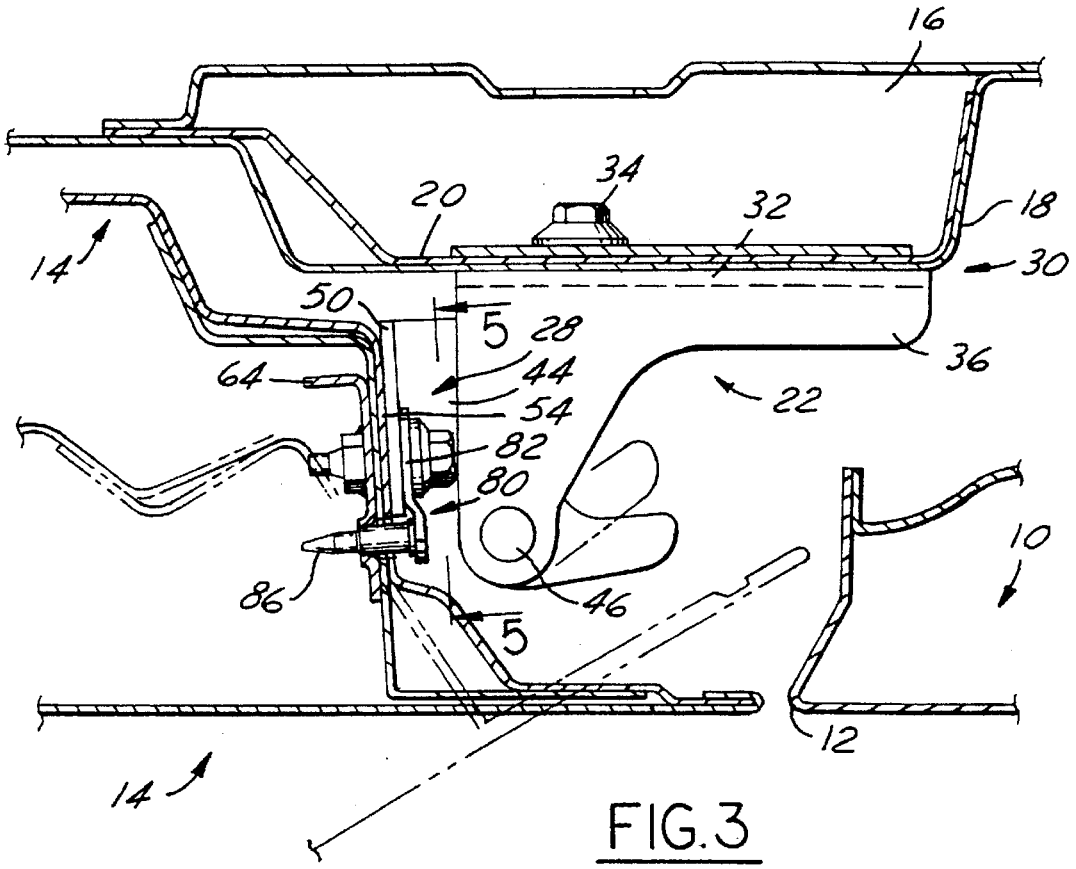
FIG. 3 is a fragmentary horizontal sectional view taken on the line 3—3 in FIG. 1.
Figure 4:
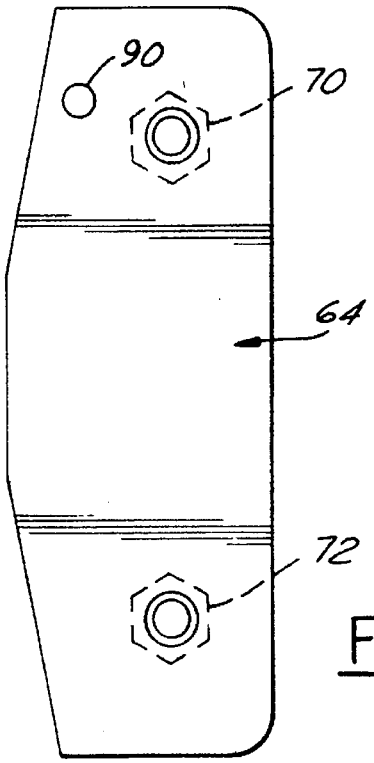
FIG. 4 is an elevational view of a tapping plate.
Figure 5:
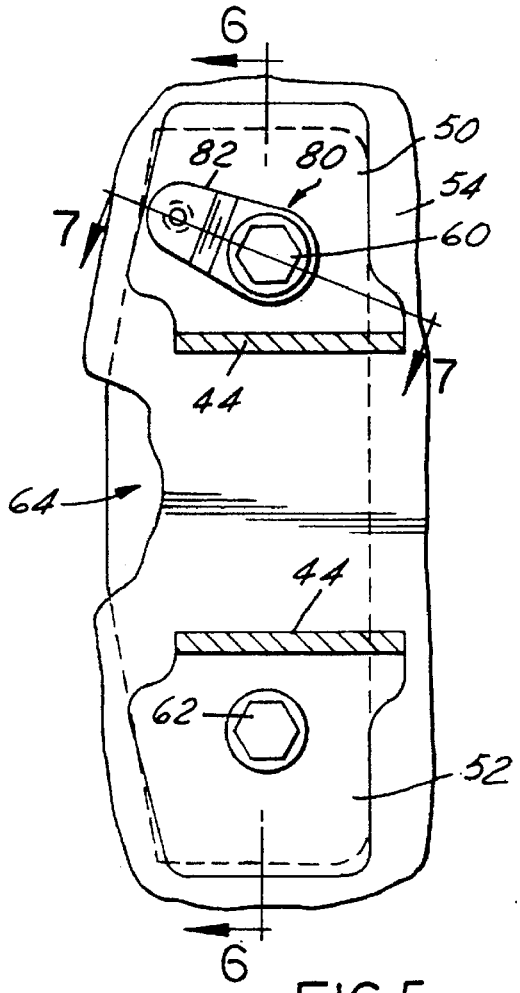
FIG. 5 is a fragmentary view, partly in section, taken on the line 5—5 in FIG. 3.

As seen in FIGS. 1 and 3, the hinge 22 including a door hinge plate 28 and a body hinge plate 30. The body hinge plate 30 is generally channel-shaped, having a base 32 fixed to the body panel 20 by headed screws 34, and upper and lower flanges 36 and 38.

The door hinge plate 30 has a body portion 42 formed with vertically-spaced walls 44 straddled by the flanges 36 and 38 of the body hinge plate 30. A pivot pin 46 for the hinge 22 extends vertically through the walls 44 of the body portion of the door hinge plate 30 and the flanges 36,38 of the body hinge plate 30.

Figure 6:
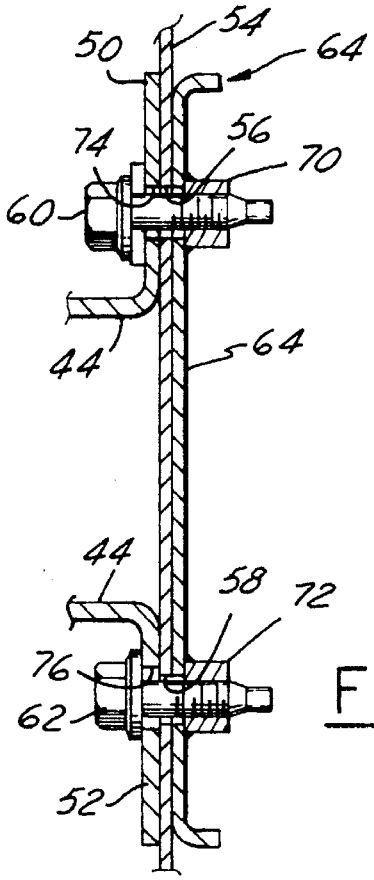
FIG. 6 is a sectional view taken on the line 6—6 in FIG. 5.
Figure 7:
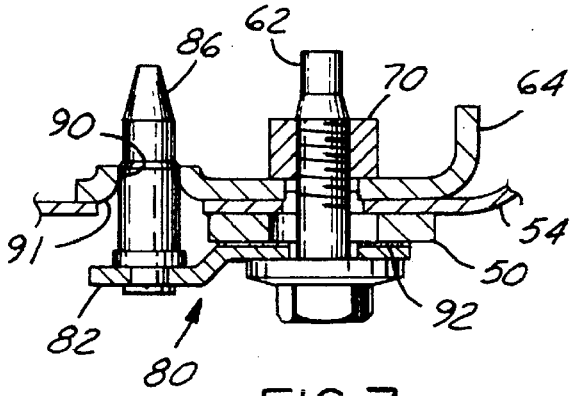
FIG. 7 is a sectional view taken on the line 7—7 in FIG. 5.

The door hinge plate 28 has upper and lower flanges 50 and 52 extending in a common plane from the top and bottom of the body portion 42. The upper and lower flanges 50 and 52 lie flush against a panel 54 of the door 14 in surface-to-surface relation therewith. The panel 54 may be a single layer of metal, as shown in FIGS. 6 and 7, or a double layer as in FIG. 3.

The door panel 54 has two vertically spaced-apart openings 56 and 58 to receive headed mounting screws 60 and 62. The openings 56 and 58 are somewhat enlarged relative to the mounting screws to permit adjustment in the mounting of the door.

Secured to the back side of the door panel 54 is a tapping plate 64. The tapping plate is secured to the door panel by any suitable means such as by welding. The tapping plate has a pair of apertures 66 and 68 and secured to the back side of the tapping over these apertures are nuts 70 and 72. The threads of the nuts are aligned with the openings 56 and 58 in the door panel 54.

The flanges 50 and 52 of the door hinge plate 28 are formed with openings 74 and 76 which are spaced apart the same distance as the openings 56 and 58 in the door panel 54 and the nuts 70 and 72. The openings 74 and 76 are slightly oversized relative to the mounting screws 60 and 62 to permit adjustment of the door.

The screws 60 and 62 extend through the aligned openings 74,76 and 56 and 58 in the door hinge plate 28 and in the door panel 54 and thread into the nuts 70 and 72 on the tapping plate 64. Before tightening the screws, the door 14 is adjusted carefully with respect to the door opening.

Figure 2:
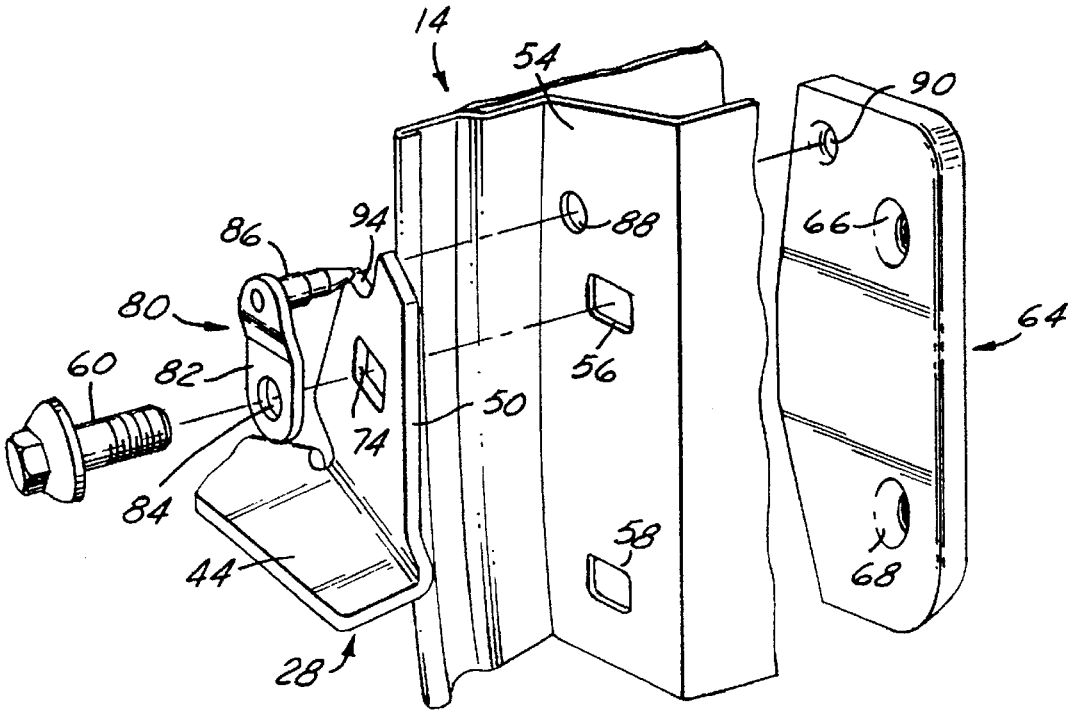
FIG. 2 is a fragmentary exploded perspective view of one of the hinge assemblies.

In order to preserve the precise mounted relationship of the door 14 with respect to the opening 12, so that the door may be removed or unhinged from the body as, for example to facilitate the mounting of various components including seating, instrument panel, etc., and then re-hinging the door in the exact same position, a locator 80 is provided for each hinge 22,24. The locator comprises a tab 82 which is adapted to overlie the outer side of one of the flanges, in this instance flange 50, of the door hinge plate 28. The tab has a hole 84 (FIG. 2) adjacent one end for alignment with the opening 74 in the flange 50 of the door hinge plate 28. The hole 84 is somewhat oversized to clear the bolt 60. The tab 82 also has a locator pin 86 which has a tapered end and which is adapted to extend through hole 88 in the door panel 54 and the registering locator hole 90 in the tapping plate 64. The locator pin 86 is adapted to have a close fit in the hole 90 in the tapping plate, but the hole 88 is oversized to clear the pin. The metal around the hole 90 in the tapping plate 64 is flared outwardly as shown in FIG. 7 to form a tapered pilot entry 91 to a guide the tapered end of the locator pin 86 into the hole.

Applied to the side of the tab 82 facing the flange 50 the door hinge plate 28 is a film 92 of a suitable adhesive such, for example, as a thermosetting resin, in this instance, an epoxy resin. The epoxy is initially uncured and not tacky. When the screw 60 is tightened and presses the tab 82 against the flange 50, the adhesive film is compressed against the abutting surface of the flange. The margin of the flange 50 of the door hinge plate is recessed at 94 to clear the locator pin 86.

In mounting the door 14 in the door opening of the car body, the door is adjusted for a proper fit in the opening, and then the screws 60 and 62 of each hinge 22,24 are applied. The upper screw 60 extends through the hole 84 in the tab, through the aligned clearance openings 74 and 56 in the flange 50 of the door hinge plate and in the door panel 54 and threads into the nut 70 in the tapping plate. The locator pin 86 at this time is extended through the opening 88 in the door panel 54 and the locator hole 90 in the tapping plate. No locator is required for the lower screw 62, that screw extending through the clearance openings 76 and 58 in the flange 52 of the door hinge plate 28 and in the door panel 54, threading into the nut 72 on the tapping plate.

After the door is properly mounted and the screws 60 and 62 securely tightened, sufficient heat is applied to activate and cure the adhesive coating on the tab 82 of each hinge 22,24 to cause the adhesive to set and bond the tab to the flange 50 of the door hinge plate. Sufficient heat is usually applied as a part of the normal painting operation in which the vehicle body and attached door are painted. Thereafter, the door may be unhinged or removed from the door hinge plates of the door hinges 22,24 by removing the screws for the purposes previously described or for any purpose, and when re-attached to the door hinge plates, the locator tab for each hinge, by entry of its locator pin in the locator hole in the tapping plate, will insure that the door is re-attached in the proper position.

We claim:

1. Hinge apparatus for a door of a motor vehicle providing precise door-on-door-off capability enabling the door to be hinged to a vehicle body post in adjusted position, unhinged, and then re-hinged in the same adjusted position, comprising:

a door panel, a body post panel, a pair of hinges connecting said door panel to said body post panel, each hinge comprising a first hinge plate connected to a first one of said panels, a second hinge plate disposed against a second one of said panels, a pivot pin pivotally connecting said first and second hinge plates, a tapping plate secured to said second panel, said tapping plate having a threaded hole therein, a locator comprising a tab secured to said second hinge plate, said tab having a clearance hole therein aligned with said threaded hole, said tab having a locator pin spaced from said clearance hole, said tapping plate having a locator hole closely receiving said locator pin, clearance openings in said second hinge plate and in said second panel aligned with said threaded hole, and a mounting screw extending through the clearance hole in said tab and through the clearance openings in said second hinge plate and second panel and threadedly engaged in said threaded hole to clamp together said tab, said second hinge plate, said second panel and said tapping plate, said clearance openings in said second hinge plate and in said second panel being large enough relative to said screw to permit adjustment of the said second hinge plate relative to the second panel before said screw is tightened.

2. Hinge apparatus for a door of a motor vehicle providing precise door-on-door-off capability enabling the door to be hinged to a vehicle body post in adjusted position, unhinged, and then re-hinged in the same adjusted position, comprising:

a door panel having inner and outer surfaces, a body post panel having inner and outer surfaces, a pair of hinges connecting said door panel to said body post panel, each hinge comprising a first hinge plate connected to said body post panel, a second hinge plate having inner and outer surfaces with the inner surface thereof abutting the inner surface of said door panel, a pivot pin pivotally connecting said first and second hinge plates, a tapping plate secured to the outer surface of said door panel, said tapping plate having a threaded hole therein, a locator comprising a tab secured to the outer surface of said second hinge plate, said tab having a clearance hole therein aligned with said threaded hole, said tab having a locator pin spaced from said clearance hole, said tapping plate having a locator hole closely receiving said locator pin, clearance openings in said second hinge plate and in said door panel aligned with said threaded hole, and a mounting screw extending through said clearance hole in said tab and through said clearance openings in said second hinge plate and said door panel and threadedly engaged in said threaded hole to clamp together said tab, said second hinge plate, said door panel and said tapping plate, said clearance openings in said second hinge plate and in said door panel being large enough relative to said screw to permit adjustment of the said second hinge plate relative to the door panel before said screw is tightened.

3. Hinge apparatus as defined in claim 2, wherein said tab is secured to the outer surface of said second hinge plate by a thermosetting adhesive.

4. Hinge apparatus as defined in claim 2, wherein said second hinge plate has a recess clearing said locator pin.

5. Hinge apparatus as defined in claim 2, wherein said tapping plate has a tapered pilot entry surrounding said locator hole to guide the locator pin into the locator hole.

6. Hinge apparatus as defined in claim 2, wherein said tapping plate has a second threaded hole therein spaced from said first-mentioned threaded hole, a second mounting screw threadedly engaged in said second threaded hole to clamp together said second hinge plate, said second panel, and said tapping plate, and second clearance openings in said second hinge plate and said second panel clearing said second mounting screw.

7. Hinge apparatus as defined in claim 6, wherein said tab is secured to the outer surface of said second hinge plate by a thermosetting adhesive, and said second hinge plate has a recess clearing said locator pin.

8. Hinge apparatus as defined in claim 7, wherein said tapping plate has a tapered pilot entry surrounding said locator hole to guide the locator pin into the locator hole.

9. In a method of hingedly mounting a door of a motor vehicle providing precise door-on-door-off capability enabling the door to be hinged to a vehicle body post in adjusted position by hinges each including pivotally connected first and second hinge plates connected respectively to a door panel and to a vehicle post panel, unhinged, and then re-hinged in the same adjusted position wherein one of the hinge plates of each hinge and one of the panels have registering clearance openings for loosely receiving a mounting screw, comprising providing a tapping plate having a threaded hole and a locating hole therein, providing a locator comprising a tab having a screw-clearing hole and having a locator pin spaced from said screw-clearing hole and having a thermosetting adhesive coating on one side thereof, securing the tapping plate to said one panel so that the threaded hole therein is aligned with the clearance openings in said one panel and said one hinge plate, applying the adhesive-coated side of the tab to said one hinge plate so that its clearance hole is aligned with the clearance openings in said one panel and said one hinge plate and with the threaded hole in the tapping plate, and so that the locator pin is extended into the locator hole in said tapping plate, adjusting the position of said one hinge plate and said one panel as desired and extending the mounting screw through the screw-clearing hole in said tab and the clearance openings in said one hinge plate and said one panel and threading it into the threaded hole in said tapping plate to clamp said one panel to the said one hinge plate and the tab to said one hinge plate, and applying heat to activate the thermosetting adhesive to bond the tab to the hinge plate.

10. The method defined in claim 9, wherein said one panel is the door panel.

11. The method defined in claim 10, wherein said one hinge plate and said one panel each have inner and outer surfaces, the inner surfaces of said one hinge plate and said one panel are in contact with one another, said tapping plate is secured to the outer surface of said second panel, and said tab is secured to the outer surface of said second hinge plate.

12. The method defined in claim 11, wherein said tapping plate has a tapered pilot entry surrounding said locator hole to guide the locator pin into the locator hole.

* * * * *